US007012371B2

(12) United States Patent
Wan et al.

(10) Patent No.: US 7,012,371 B2
(45) Date of Patent: Mar. 14, 2006

(54) PLASMA DISPLAY PANEL STRUCTURE WITH SHIELDING LAYER

(75) Inventors: Shiang Wen Wan, Sanchong (TW); Yao Ching Su, Taoyuan (TW)

(73) Assignee: AU Optronics Corporation, Hsinchu (TW)

( * ) Notice: Subject to any disclaimer, the term of this patent is extended or adjusted under 35 U.S.C. 154(b) by 167 days.

(21) Appl. No.: 10/704,077

(22) Filed: Nov. 7, 2003

(65) Prior Publication Data

US 2005/0099122 A1 May 12, 2005

(51) Int. Cl.
*H01J 17/49* (2006.01)

(52) U.S. Cl. ..... 313/582; 313/584; 313/238

(58) Field of Classification Search ..... 313/582–587, 313/110, 112, 609, 610, 238, 240, 466, 473, 313/313

See application file for complete search history.

(56) References Cited

U.S. PATENT DOCUMENTS

| | | | | |
|---|---|---|---|---|
| 5,754,003 | A * | 5/1998 | Murai et al. | 313/582 |
| 5,952,782 | A * | 9/1999 | Nanto et al. | 313/584 |
| 5,967,872 | A | 10/1999 | Betsui et al. | 445/24 |
| 6,373,195 | B1 | 4/2002 | Whang et al. | 315/169.3 |
| 6,653,793 | B1 * | 11/2003 | Itokawa et al. | 315/169.1 |
| 6,887,631 | B1 * | 5/2005 | Kiguchi et al. | 430/7 |
| 2003/0197468 | A1 * | 10/2003 | Shibata et al. | 313/586 |

* cited by examiner

*Primary Examiner*—Joseph Williams
*Assistant Examiner*—Kevin Quarterman
(74) *Attorney, Agent, or Firm*—Baker & McKenzie

(57) ABSTRACT

The present application describes a plasma display panel structure with high contrast ratio and high luminance. In one embodiment, display cells in the plasma display panel are arranged in a delta structure. The delta structure of display cells enhances the luminance and contrast ratio of the plasma display panel. In some embodiments, a light-shielding layer is configured to selectively exclude display cells of one or more selected colors to enhance the color temperature of the plasma display panel.

28 Claims, 6 Drawing Sheets

PLASMA DISPLAY PANEL STRUCTURE WITH SHIELDING LAYER

FIELD OF THE INVENTION

The present invention generally relates to plasma display panels and, more particularly, to a plasma display panel with enhanced luminance and contrast ratio.

DESCRIPTION OF THE RELATED

Generally, plasma display panels are used as large screen displays. Typically, plasma display panels are flat and provide better image quality compared to cathode ray tube displays. Plasma display panels include display cells filled with a discharge gas. Each display cell is coated with a light-emitting layer typically made of a phosphorous-based material. To produce an image in the plasma display panel, an electric bias is applied to select one or more display cells. Upon receiving the electrical bias, the discharge gas in the selected display cell emits ultraviolet rays. When ultraviolet rays strike the light-emitting layer of the selected display cell, the light-emitting layer produces a visible color light. The color of the visible light depends upon the composition of the phosphorous-based material of the light-emitting layer.

FIG. 1A illustrates a structure of a prior art plasma display panel 100 described in the disclosure of U.S. Pat. No. 5,952,782, which is incorporated herein by reference. The plasma display panel 100 includes a front glass substrate 110 and a rear glass substrate 112. The plasma display panel 100 further includes display cells 130 formed by rib barriers 129. Display cells 130 are arranged in a matrix structure and the boundary area of each display cell 130 substantially aligns with the boundary area of adjacent display cells. The display cell 130 includes a discharge gap 114. A pair of display electrodes 122*a* and 122*b*, and an address electrode 118 is coupled to each display cell. The address electrode 118 orthogonally intersects each pair of the display electrodes 122*a* and 122*b*.

The display cell 130 is coated with stripes of a phosphors layer 116 configured to emit light of a predetermined color. The discharge gap 114 is filled with a discharge gas. When an electric bias is applied to a selected display cell 130, the discharge gas in the selected display cell emits ultraviolet rays. When ultraviolet rays strike the phosphorous layer 116 of the selected display cell 130, the phosphorous layer 116 emits visible light of a predetermined color.

FIG. 1B is a cross-sectional view of the plasma display panel 100 taken along axis 1B depicted in FIG. 1A. A gap 126 is defined between the pair of display electrodes. The gas discharge does not occur in the gap 126. A light-shielding layer 128 is typically placed in the gap 126 to increase the contrast ratio of the plasma display panel 100. Because the boundary area of each display cell is substantially aligned with the boundary area of adjacent display cells, the light from one display cell leaks into adjacent display cells, which adversely affects the overall luminance and contrast ratio of the plasma display panel 100. Therefore, there is a need for a plasma display panel architecture that can provide enhanced luminance and contrast ratio.

SUMMARY OF THE INVENTION

The present application describes a plasma display panel structure configured to provide enhanced luminance and display contrast ratio. In one embodiment, display cells in the plasma display panel are arranged in a delta structure. The delta structure of display cells facilitates the coating of a light-shielding layer around the boundary areas of display cells, which enhances the luminance and contrast ratio of the plasma display panel. Because the boundary areas of display cells in the delta structure do not substantially align with each other, the light-shielding layer in the delta structure absorbs substantially more light than the light-shielding layer of conventional matrix-based plasma display panels.

In some embodiments, the light-shielding layer can be configured to selectively exclude display cells of one or more selected colors, which can improve the color temperature of the plasma display panel. The color temperature typically characterizes the redness or blueness of the plasma display panel. For example, if an application requires enhanced luminance of one color such as blue, then blue display cells can be excluded from the light-shielding layer, which results in enhanced blue luminance on the plasma display panel relative to the luminance of other colors (e.g., red and green). Similarly, the light-shielding layer can be configured to exclude display cells of a combination of colors to provide a desired color balance for the plasma display panel.

The foregoing is a summary and shall not be construed to limit the scope of the claims. The operations and structures disclosed herein may be implemented in a number of ways, and such changes and modifications may be made without departing from this invention and its broader aspects. Other aspects, inventive features, and advantages of the invention, as defined solely by the claims, are described in the non-limiting detailed description set forth below.

DETAILED DESCRIPTION OF THE EMBODIMENT(S)

Figure 1A:
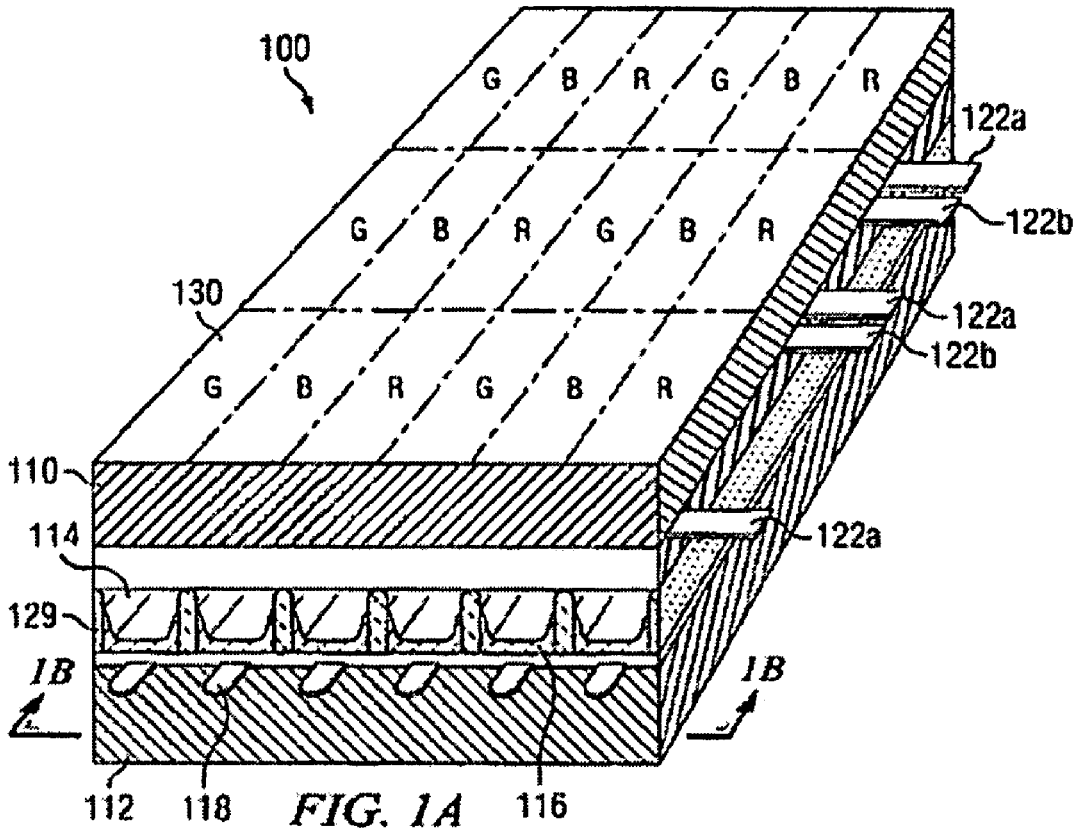
FIG. 1A (PRIOR ART)
FIG. 1A is a perspective view of the structure of a prior art plasma display panel.
Figure 1B:
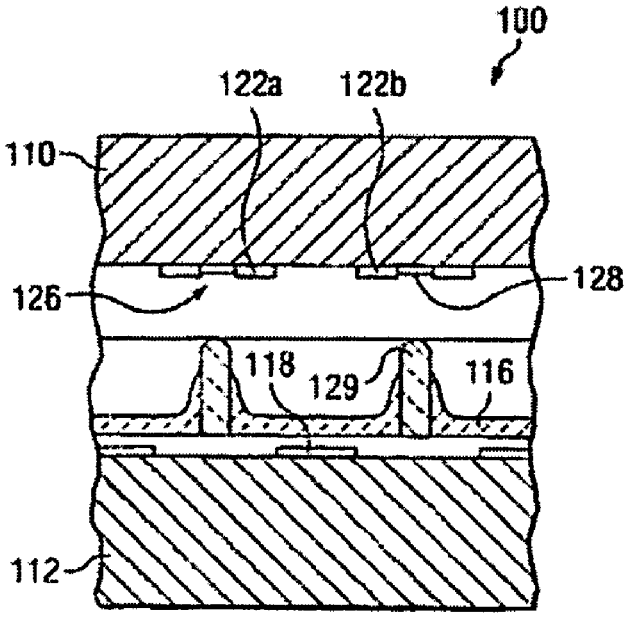
FIG. 1B (PRIOR ART)
FIG. 1B is a cross-sectional view of the prior art plasma display panel.
Figure 2A:
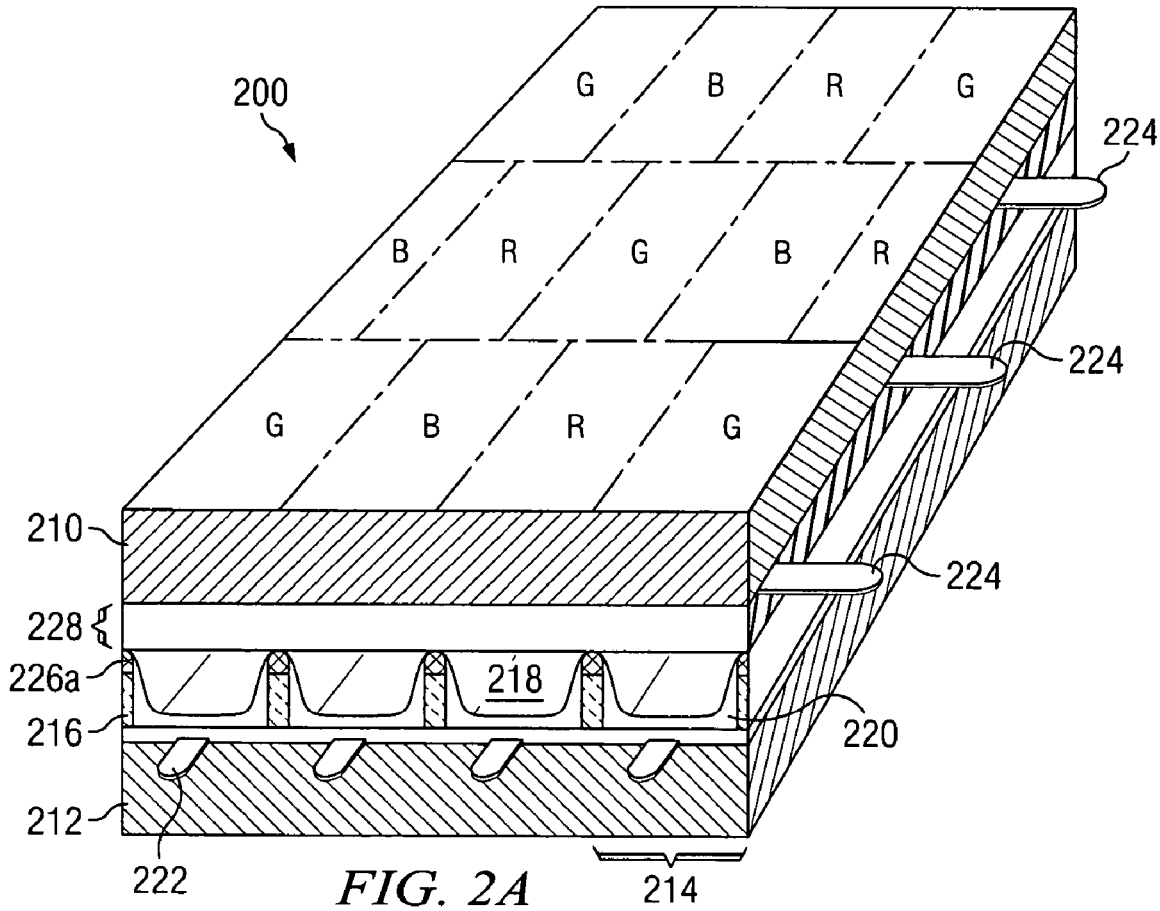
FIG. 2A is a perspective view of an exemplary plasma display panel with display cells arranged in a delta structure.

FIG. 2A is a perspective view of an exemplary plasma display panel 200 with display cells 214 arranged in a delta structure. The plasma display panel 200 includes a front substrate 210 and a rear substrate 212. In the present example, the front substrate 210 and the rear substrate 212 are made of glass. The front substrate 210 and the rear substrate 212 form display cells 214. Display cells 214 are delimited by partition walls 216. Each display cell 214 is coupled to at least one display electrode 224 and one address electrode 222. A gas discharge gap 218 is formed in each display cell 214. The inner surface of each display cell 214 is covered with a light-emitting layer 220. The light-emitting layer 220 can be made of a phosphorous-based material. A dielectric layer 228 separates display cells 214 from the front substrate 210.

Figure 2B:
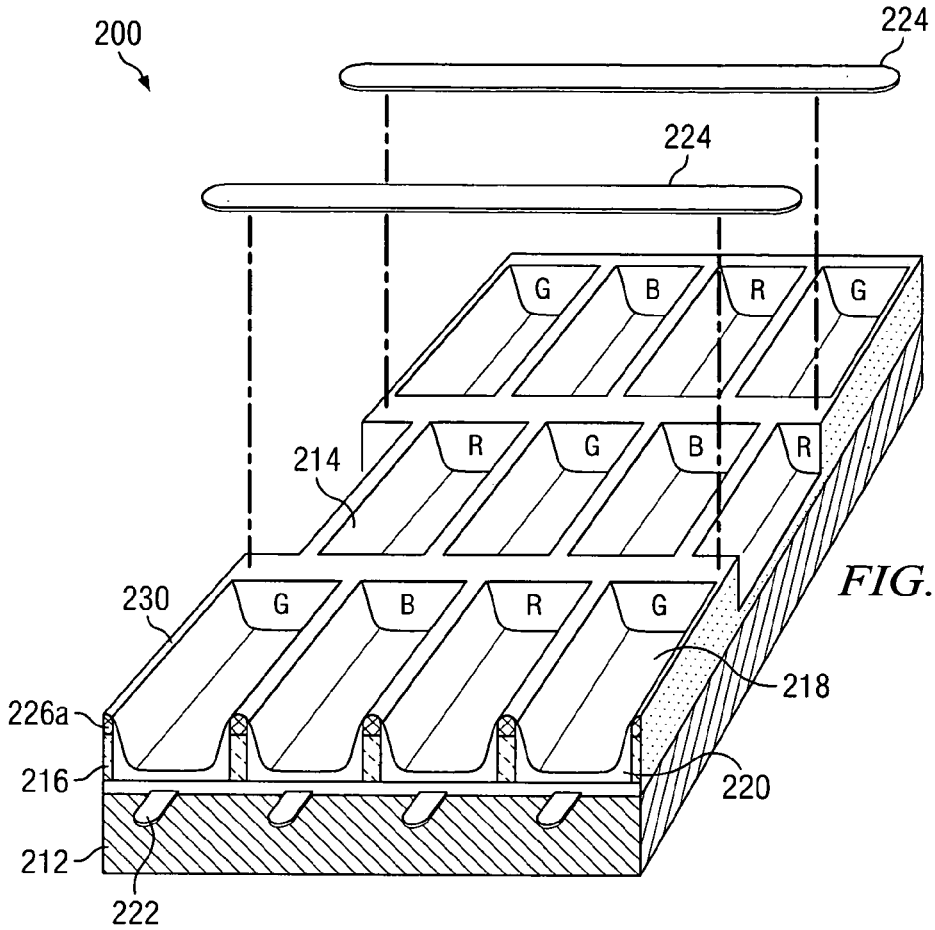
FIG. 2B is a perspective view of an internal structure of the exemplary plasma display panel of FIG. 2A.

FIG. 2B is a perspective view of an internal structure of the exemplary plasma display panel 200 of FIG. 2A. The gas discharge gap 218 in each display cell 214 is filled with a discharge gas. In the present example, light-emitting layers 220 are configured to emit light of red, green, or blue color. The color of light emitted by light-emitting layers 220 depends upon the composition of the phosphorous-based material. Display electrodes 224 are formed over an inner surface of the front substrate 210. Each display electrode 224 alternates with rows of display cells 214. The dielectric layer 228 covers display electrodes 224 over the inner surface of the front substrate 210 (not shown). Address electrodes 222 are configured on an inner surface of the rear substrate 212 under light-emitting layers 220. A light-shielding layer 230 is formed on the boundary area of each display cell 214. The light-shielding layer 230 is configured to absorb light. The light-shielding layer 230 can be configured using a baked photoresist material including a dark pigment.

Figure 2C:
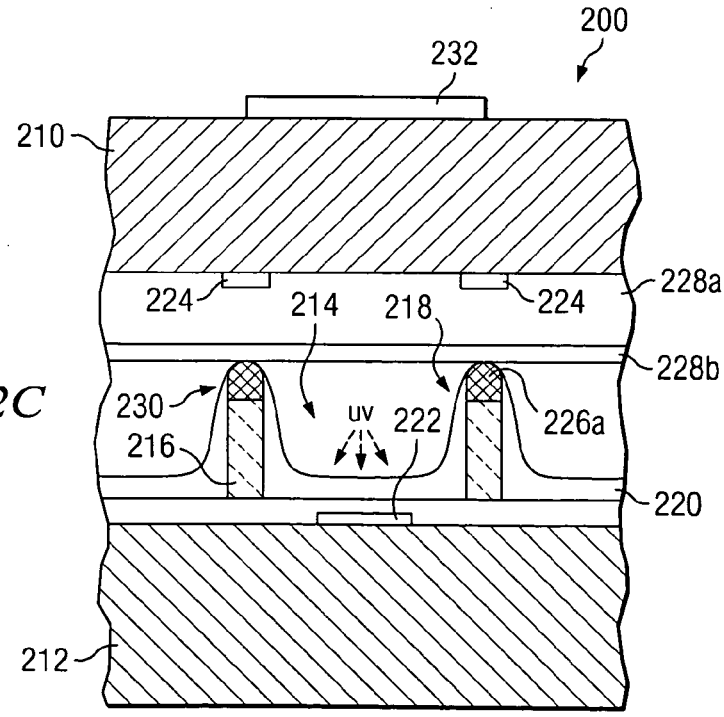
FIG. 2C is a cross-sectional view of an exemplary plasma display panel with light-shielding layers covering the top of the partition ribs.

FIG. 2C is a cross-sectional view of the exemplary plasma display panel 200 of FIG. 2A with a light-shielding layer 230 including a light-shielding material 226*a* at the top of the partition wall 216. In the present example, the dielectric layer 228 includes two layers, a dielectric layer 228*a* and a protective layer 228*b*. The dielectric layer 228*a* is configured using dielectric material. The protective layer 228*b* is configured to protect the dielectric layer 228*a* against electric discharge generated to stimulate the discharge gas. In the present example, the protective layer 228*b* comprises Magnesium Oxide (MgO). During the operation of the plasma display panel 200, a display cell 214 is selected by applying a voltage between an address electrode 222 and a display electrode 224 corresponding to the selected display cell 214. A driving voltage is then applied between the two electrodes to create an electric discharge on the surface of the dielectric layer 228 over the selected display cell 214.

The electric discharge stimulates the discharge gas within the discharge gap 218 of the selected display cell 214. The stimulated gas then generates ultraviolet rays. When ultraviolet rays strike the light-emitting layer 220 of the selected display cell 214, the light-emitting layer 220 begins to emit light of a specific color based on the composition of the phosphorous-based material. The light-shielding layer 230 absorbs light at the boundary area of the selected display cell 214, which improves the contrast ratio of the plasma display panel 200. Optional color filters 232 can be added on the substrate 210 corresponding to each display cell 214 to further improve color balance, contrast ratio, and luminance of the plasma display panel 200.

Figure 2D:
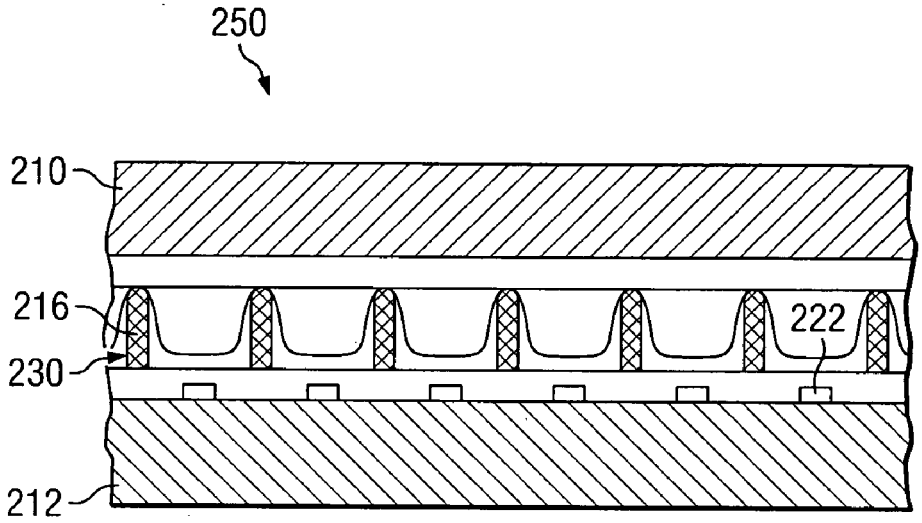
FIG. 2D is a cross-sectional view of an exemplary plasma display panel with light-shielding layers covering the entire surface of the partition ribs.

FIG. 2D is a cross-sectional view of an exemplary plasma display panel 250 including a light-shielding layer 230. The light-shielding layer 230 substantially covers the partition wall 216. In the present example, the light-shielding layer 230 further enhances the contrast ratio and luminance of the plasma display panel 250.

Figure 2E:
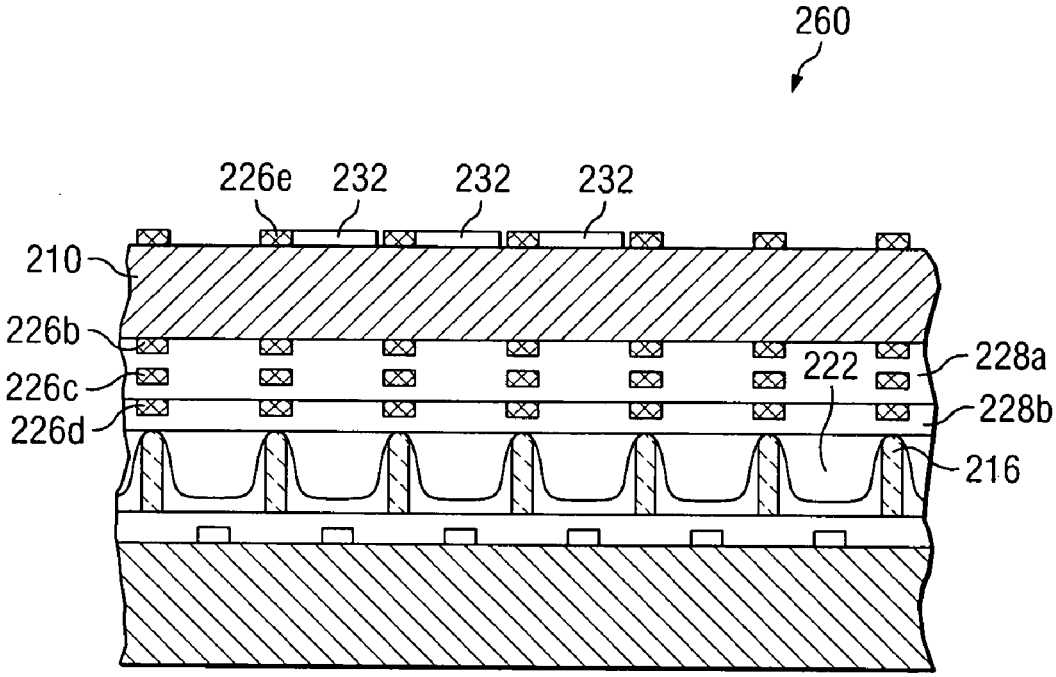
FIG. 2E is a cross-sectional view of an exemplary plasma display panel with various implementations of light-shielding layers.

FIG. 2E is a cross-sectional view of an exemplary plasma display panel 260 with various light-shielding layers. In the present example, the plasma display panel 260 includes a light-shielding layer 226*b* on an inner surface of the front substrate 210, a light-shielding layer 226*c* inside the dielectric layer 228*a*, a light-shielding layer 226*d* on an inner surface of the dielectric layer 228*a*, and a light-shielding layer 226*e* on an outer surface of the front substrate 210. The light shielding layers 226*b*, 226*c*, 226*d*, and 226*e* prevent contrast degradation due to light reflection within the plasma display panel 260.

Figure 3A:
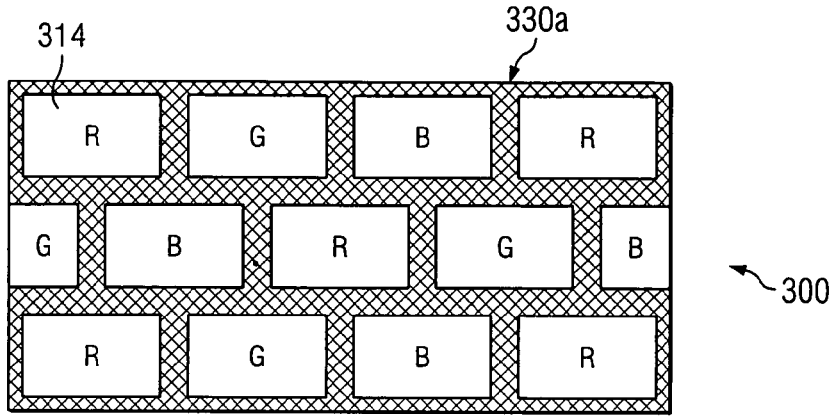
FIG. 3A is a plan view of an exemplary plasma display panel with light-shielding layers covering the boundary area of display cells arranged in a delta structure.

FIG. 3A is a plan view of an exemplary plasma display panel 300 with a light-shielding layer 330*a*. The light-shielding layer 330*a* covers boundary areas of display cells 314 that are arranged in a delta structure. The light-shielding layer 330*a* forms a mesh that substantially encloses boundary areas of display cells 314. Because of the delta structure, the light-shielding layer 330*a* absorbs substantially more light than the light-shielding layer of conventional matrix-based plasma display panel. The light-shielding layer 330*a* substantially enhances the contrast ratio of the plasma display panel 300.

Figure 3B:
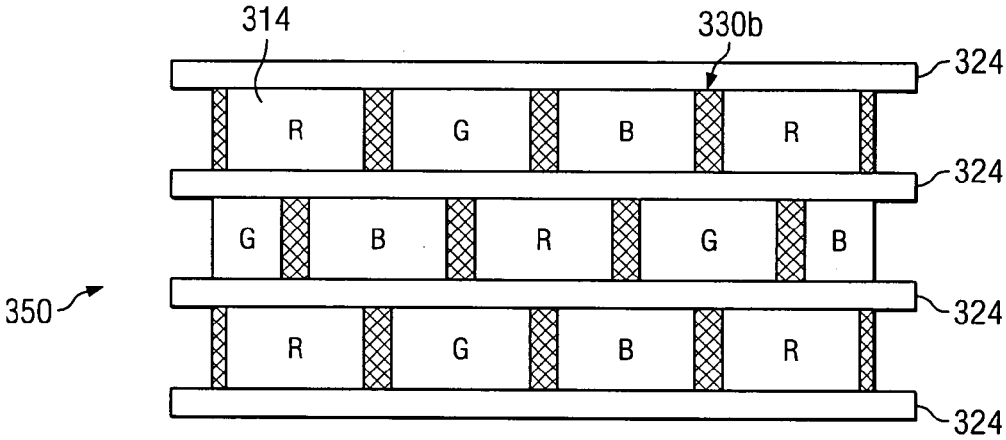
FIG. 3B is a plan view of another exemplary implementation of light-shielding layers in a plasma display panel.

FIG. 3B is a plan view of another exemplary implementation of a light-shielding layer 330*b* in a plasma display panel 350. In the present example, the light-shielding layer 330*b* is formed around a boundary area of the display cell 314. In the present example, the light-shielding layer 330*b* does not overlap display electrodes 324.

Figure 3C:
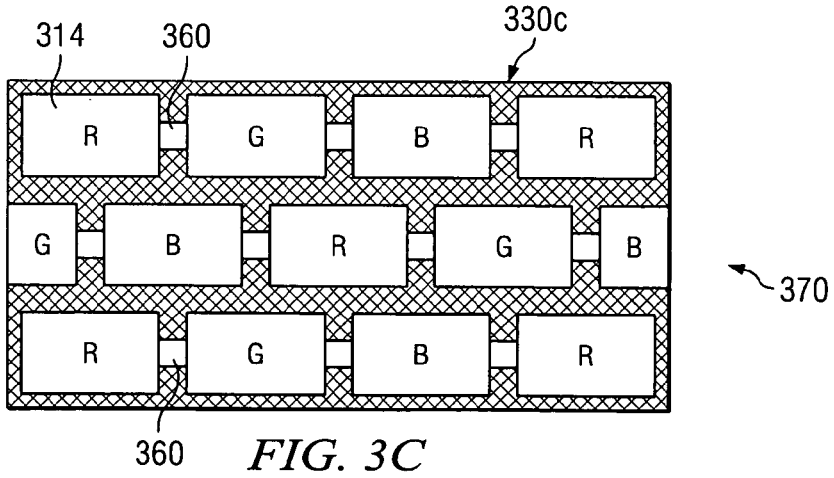
FIG. 3C is a plan view of yet another exemplary implementation of light-shielding layers in a plasma display panel.

FIG. 3C is a plan view of yet another exemplary implementation of a light-shielding layer 330*c* in a plasma display panel 370. In the present example, the light-shielding layer 330*c* is formed around boundary areas of display cells 314. The light-shielding layer 330*c* includes a partition gap 360. The partition gap 360 is located over the top of the partition wall. The partition gap 360 creates a non-uniform contact between the top of the partition wall and the light-shielding layer 330*c*, which facilitates gas evacuation from the display cell 314.

Figure 3D:
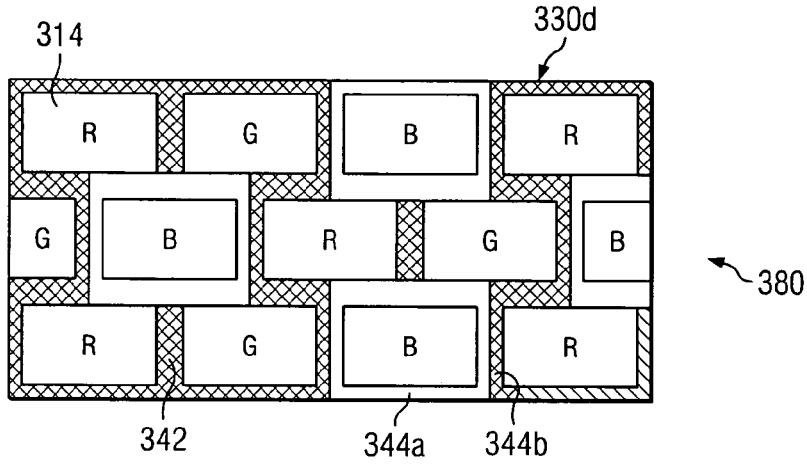
FIG. 3D is a plan view of an exemplary plasma display panel with color-selective light-shielding layers for display cells arranged in a delta structure.

FIG. 3D is a plan view of an exemplary plasma display panel 380 with a color-selective light-shielding layer 330*d*. The color-selective light-shielding layer 330*d* is configured to adjust the color temperature of the plasma display panel 380. The color temperature typically characterizes the redness or blueness of the display panel. To adjust the color temperature, the color-selective light-shielding layer 330*d* can be configured to exclude display cells of one or more colors. In the present example, the color-selective light-shielding layer 330*d* is configured to substantially enclose red and green display cells, while substantially excluding blue display cells. The color-selective light-shielding layer 330*d* substantially covers a boundary area 342, which is not contiguous to blue display cells. The color-selective light-shielding 330*d* is further configured to substantially exclude a boundary area 344*a*, which is contiguous to blue display cells. In some embodiments, a thin color-selective light-shielding layer can be formed at a boundary area 344*b*, which is adjacent to blue display cells, to further improve the contrast.

Figure 4A:
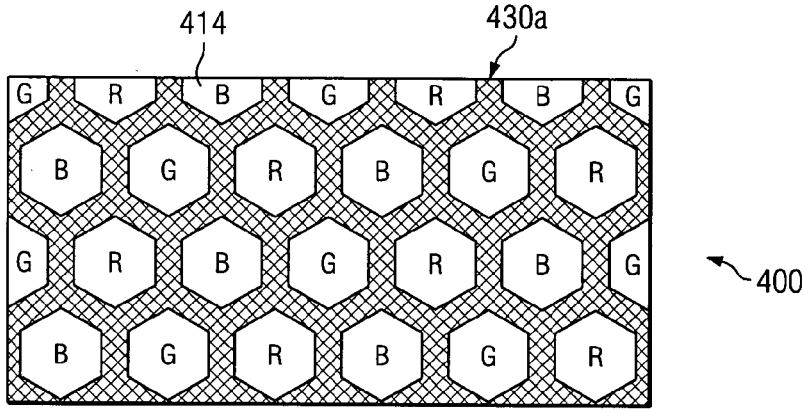
FIG. 4A is a plan view of an exemplary plasma display including light-shielding layer covering hexagonal-shaped display cells.

FIG. 4A is a plan view of an exemplary plasma display panel 400 including hexagonal-shaped display cells 414 arranged in a honeycomb structure. The hexagonal shape of the display cell 414 further improves the luminance of the plasma display panel 400. A light-shielding layer 430*a* forms a mesh substantially covering the boundary area of each display cell 414.

Figure 4B:
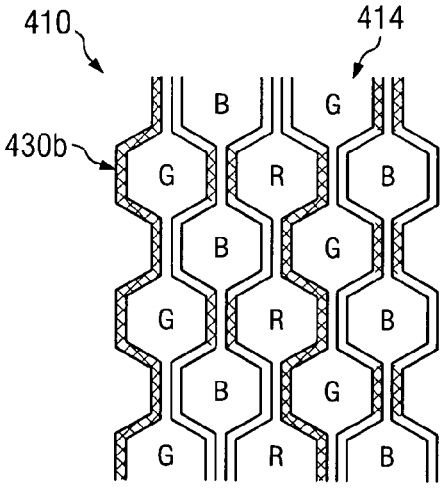
FIG. 4B illustrates an exemplary implementation of color-selective light-shielding layers in a plasma display panel with hexagonal-shaped display cells.

FIG. 4B illustrates an exemplary color-selective light-shielding layer 430*b* in a plasma display panel 410. The plasma display panel 410 includes hexagonal-shaped display cells 414. In the present example, the color-selective light-shielding layer 430*b* is configured to exclude boundary areas contiguous to blue display cells, while substantially enclosing boundary areas contiguous to red and green display cells. The color-selective light-shielding layer 430*b* therefore adjusts the color temperature of the plasma display panel 410.

Figure 4C:
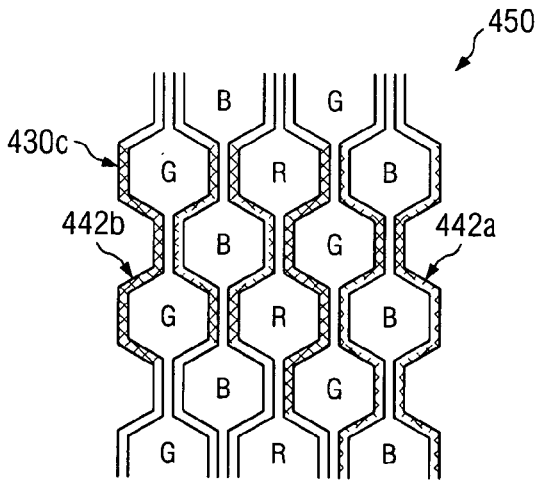
FIG. 4C is another exemplary implementation of color-selective light-shielding layers in a plasma display panel with hexagonal-shaped display cells.

FIG. 4C is another exemplary implementation of a color-selective light-shielding layer 430*c* in a plasma display panel 450 with hexagonal-shaped display cells. In the present example, a thin coating of the color-selective light-shielding layer 430*c* is formed around a boundary area 442*a*, which is contiguous to blue display cells. The color-selective light-shielding layer 430*c* substantially covers a boundary area 442*b*, which is contiguous to red and green display cells. The color-selective light-shielding layer 430*c* adjusts the color temperature of the plasma display panel 450.

Realizations in accordance with the present invention have been described in the context of particular embodiments. These embodiments are meant to be illustrative and not limiting. Many variations, modifications, additions, and improvements are possible. Accordingly, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of claims that follow. Finally, structures and functionality presented as discrete components in the exemplary configurations may be implemented as a combined structure or component. These and other variations, modifications, additions, and improvements may fall within the scope of the invention as defined in the claims that follow.

The section headings in this application are provided for consistency with the parts of an application suggested under 37 CFR 1.77 or otherwise to provide organizational cues. These headings shall not limit or characterize the invention(s) set out in any patent claims that may issue from this application. Specifically and by way of example, although the headings refer to a "Field of the Invention," the claims should not be limited by the language chosen under this heading to describe the so-called field of the invention. Further, a description of a technology in the "Description of Related Art" is not be construed as an admission that technology is prior art to the present application. Neither is the "Summary of the Invention" to be considered as a characterization of the invention(s) set forth in the claims to this application. Further, the reference in these headings to "Invention" in the singular should not be used to argue that there is a single point of novelty claimed in this application. Multiple inventions may be set forth according to the limitations of the multiple claims associated with this patent specification, and the claims accordingly define the invention(s) that are protected thereby. In all instances, the scope of the claims shall be considered on their own merits in light of the specification but should not be constrained by the headings included in this application.

What is claimed is:

1. A display panel, comprising:

a front substrate;

a rear substrate;

a plurality of display cells formed according to a delta structure between the front substrate and the rear substrate, the display cells being delimited by partition walls, and the display cells including light-emitting layers configured to emit light of at least one color;

a plurality of display electrodes, wherein each one of the plurality of display cells is coupled to at least one of the plurality of display electrodes;

a plurality of address electrodes, wherein each one of the plurality of display cells is coupled to at least one of the plurality of address electrodes;

at least one light-shielding layer, substantially overlapping locations corresponding to cell boundary areas of the plurality of display cells, wherein the at least one light-shielding layer is configured to selectively substantially exclude a cell boundary area of at least one display cell.

2. A display panel according to claim 1, wherein the at least one light-shielding layer forms a mesh that substantially encloses an area around the plurality of display cells.

3. A display panel according to claim 1, wherein the at least one light-shielding layer is configured to selectively substantially exclude a cell boundary area of at least one display cell including the light-emitting layers configured to emit light of at least one selected color.

4. A display panel according to claim 1, wherein the at least one light-shielding layer is configured to have a first width at cell boundary areas contiguous to display cells including the light-emitting layers configured to emit light of a first color, and a second width at cell boundary areas not contiguous to the display cells including the light-emitting layers configured to emit light of the first color, wherein the second width is greater than the first width.

5. A display panel according to claim 1, wherein the at least one light-shielding layer is formed at cell boundary areas of the plurality of display cells that are not overlapped by the plurality of display electrodes.

6. A display panel according to claim 1, wherein the at least one light-shielding layer is configured with a photoresist material including at least one dark pigment.

7. A display panel according to claim 1, wherein the at least one light-shielding layer is formed on top of the partition walls.

8. A display panel according to claim 1, wherein the at least one light-shielding layer is formed on an outer surface of the front substrate.

9. A display panel according to claim 1, further comprising:

a dielectric layer covering an inner surface of the front substrate, wherein the at least one light-shielding layer is formed inside the dielectric layer.

10. A display panel according to claim 1, wherein the at least one light-shielding layer is formed by including dark pigments in the partition walls.

11. A display panel according to claim 1, wherein the plurality of display cells includes hexagonal-shaped display cells.

12. A display panel according to claim 1, further comprising:

a plurality of color filters formed on an outer surface of the front substrate corresponding to a color light emitted by the plurality of display cells.

13. A display panel, comprising:

a plurality of display cells substantially enclosed by partition walls between a front substrate and a rear substrate, wherein the display cells include light-emitting layers configured to emit light of at least one color;

a plurality of display electrodes, wherein each one of the display cells is coupled to at least one of the plurality of display electrodes;

a plurality of address electrodes, wherein each one of the display cells is coupled to at least one of the plurality of address electrodes;

a light-shielding layer, substantially overlapping locations corresponding to cell boundary areas of the plurality of display cells, wherein the light-shielding layer is configured to have a first width at cell boundary areas contiguous to display cells including the light-emitting layers configured to emit light of a first color, and a second width at cell boundary areas contiguous to display cells including the light-emitting layers configured to emit light of at least a second color, wherein the second width is greater than the first width.

14. A display panel according to claim 13, wherein the display cells are arranged in a delta structure.

15. A display panel according to claim 13, wherein the light-shielding layer forms a mesh that substantially encloses the plurality of display cells.

16. A display panel according to claim 13, wherein the light-shielding layer is configured to selectively substantially exclude cell boundary areas of at least one display cell.

17. A display panel according to claim 13, wherein the light-shielding layer is formed at cell boundary areas that are not overlapped by the display electrodes.

18. A display panel according to claim 13, wherein the plurality of display cells includes hexagonal shaped display cells.

19. A display panel comprising:

a front substrate;

a rear substrate;

a plurality of display cells formed between the front substrate and the rear substrate, the display cells being delimited by partition walls and including light-emitting layers configured to emit light of at least one color;

a plurality of display electrodes, wherein each one of the display cells is coupled to at least one of the plurality of display electrodes;

a plurality of address electrodes, wherein each one of the display cells is coupled to at least one of the plurality of address electrodes; and at least one color-selective light-shielding layer overlapping locations corresponding to cell boundary areas of the plurality of display cells, wherein the at least one color-selective light-shielding layer is configured to selectively substantially exclude cell boundary areas of display cells including the light-emitting layers configured to emit light of a selected color.

20. A display panel according to claim 19, wherein the color-selective light-shielding layer forms a mesh that substantially encloses an area around the plurality of display cells.

21. A display panel according to claim 19, wherein the color-selective light-shielding layer is configured to have a first width at cell boundary areas contiguous to display cells including the light-emitting layers configured to emit light of the selected color and a second width at cell boundary areas not contiguous to display cells including the light-emitting layers configured to emit light of the selected color, wherein the second width is greater than the first width.

22. A display panel according to claim 19, wherein the color-selective light-shielding layer is formed at cell boundary areas that are not overlapped by the plurality of display electrodes.

23. A display panel according to claim 19, wherein the color-selective light-shielding layer is formed on an outer surface of the front substrate.

24. A display panel according to claim 19, further comprising: a dielectric layer covering an inner surface of the front substrate, wherein the color-selective light-shielding layer is formed inside the dielectric layer.

25. A display panel according to claim 19, wherein the light-shielding layer is formed by including dark pigments in the partition walls.

26. A display panel according to claim 19, wherein the plurality of display cells includes hexagonal-shaped display cells.

27. A display panel according to claim 19, further comprising:

a plurality of color filters formed on an outer surface of the front substrate corresponding to a color light emitted by the plurality of display cells.

28. A display panel according to claim 19, wherein the plurality of display cells are formed according to a delta structure.

* * * * *